US009952025B2

(12) United States Patent
Bialy et al.

(10) Patent No.: US 9,952,025 B2
(45) Date of Patent: Apr. 24, 2018

(54) FIREARM PROJECTILE USABLE AS A HAND GRENADE

(71) Applicants: ISPRA LTD., Herzliya (IL); YESH ON LTD., Herzliya (IL)

(72) Inventors: Yacov Bialy, Ramat Hasharon (IL); Yohanan Stein, Herzliya (IL)

(73) Assignee: YESH ON LTD., Herzelya (IL)

( * ) Notice: Subject to any disclaimer, the term of this patent is extended or adjusted under 35 U.S.C. 154(b) by 0 days.

(21) Appl. No.: 15/240,094

(22) Filed: Aug. 18, 2016

(65) Prior Publication Data

US 2017/0191810 A1 Jul. 6, 2017

(51) Int. Cl.

| | |
|---|---|
| ***F42B 12/42*** | (2006.01) |
| ***F42B 30/04*** | (2006.01) |
| ***F42B 27/00*** | (2006.01) |
| ***F42B 12/46*** | (2006.01) |
| ***F42C 15/20*** | (2006.01) |
| ***F42C 15/34*** | (2006.01) |

(52) U.S. Cl.

CPC ..... *F42B 12/42* (2013.01); *F42B 12/46* (2013.01); *F42B 27/00* (2013.01); *F42B 30/04* (2013.01); *F42C 15/20* (2013.01); *F42C 15/34* (2013.01)

(58) Field of Classification Search

CPC ..... F42B 12/42; F42B 12/46; F42B 12/20; F42B 12/207; F42B 12/00; F42B 27/00; F42B 30/04; F42C 15/20; F42C 15/34

USPC ..... 102/346, 482, 483, 368, 491

See application file for complete search history.

(56) References Cited

U.S. PATENT DOCUMENTS

| | | | | | |
|---|---|---|---|---|---|
| 1,309,280 | A * | 7/1919 | Farrell, Jr. | F42B 30/04 | 102/483 |
| 1,448,436 | A * | 3/1923 | Day | F42B 30/04 | 102/484 |
| 2,083,665 | A * | 6/1937 | Pihl | F42B 5/067 | 102/431 |
| 2,368,064 | A * | 1/1945 | Fanger | F42B 27/00 | 102/483 |
| 2,515,180 | A * | 7/1950 | Barker | F41A 1/08 | 42/40 |
| 2,982,181 | A * | 5/1961 | Panzica | F41A 9/25 | 42/39.5 |
| 3,820,463 | A * | 6/1974 | Leonard et al. | F42B 5/02 | 102/434 |
| 5,074,217 | A * | 12/1991 | Gabriels | F42B 27/08 | 102/482 |
| 5,189,250 | A * | 2/1993 | Shaphyr | F42B 10/16 | 102/247 |
| 6,293,040 | B1 * | 9/2001 | Luth | F41A 11/02 | 42/75.01 |
| 6,343,431 | B1 * | 2/2002 | Brunn | F41C 27/06 | 42/105 |
| 6,470,806 | B1 * | 10/2002 | Murray | F42B 3/16 | 102/370 |

(Continued)

*Primary Examiner* — John Cooper

(74) *Attorney, Agent, or Firm* — Dekel Patent Ltd.; David Klein

(57) ABSTRACT

A projectile includes a body containing pyrotechnic material. A rear cap closes a rear end of the body. A pyrotechnic unit includes an ignitor in communication with the pyrotechnic material. A striker is arranged to strike a primer of the pyrotechnic unit. A safety lever is arranged initially to restrain movement of the striker towards the pyrotechnic unit. An external safety keeper is arranged initially to clamp a portion of the safety lever to the body.

3 Claims, 1 Drawing Sheet

(56) References Cited

U.S. PATENT DOCUMENTS 6,877,434 B1* 4/2005 McNulty, Jr. ..... F41H 13/0025 102/502
8,272,328 B1* 9/2012 Gorman ..... F42B 12/58 102/482
2002/0088367 A1* 7/2002 MacAleese ..... F42B 12/36 102/502
2002/0108526 A1* 8/2002 Wes ..... F42B 8/26 102/482
2003/0089018 A1* 5/2003 Reynolds ..... F41A 3/38 42/105
2009/0277069 A1* 11/2009 Delmonico ..... F41C 27/00 42/105
2010/0212533 A1* 8/2010 Brunn ..... F42B 4/26 102/502
2010/0242775 A1* 9/2010 Schneider ..... F41H 13/00 102/504
2010/0282058 A1* 11/2010 Nelson ..... F41A 19/08 89/27.12
2011/0005373 A1* 1/2011 Martinez ..... B63G 9/04 89/1.34
2012/0151813 A1* 6/2012 Brown ..... F41C 7/00 42/73
2012/0211591 A1* 8/2012 Sandomirsky ..... F42C 13/023 244/3.16
2012/0255427 A1* 10/2012 Iannatuono, Sr. ..... F41A 21/10 89/14.7
2013/0319278 A1* 12/2013 Kravel ..... F42B 12/48 102/334
2014/0331884 A1* 11/2014 Willhelm ..... F42B 12/204 102/439
2014/0352188 A1* 12/2014 Widder ..... F42B 5/184 42/14
2015/0159981 A1* 6/2015 Forbes ..... F42B 5/08 89/14.05

* cited by examiner

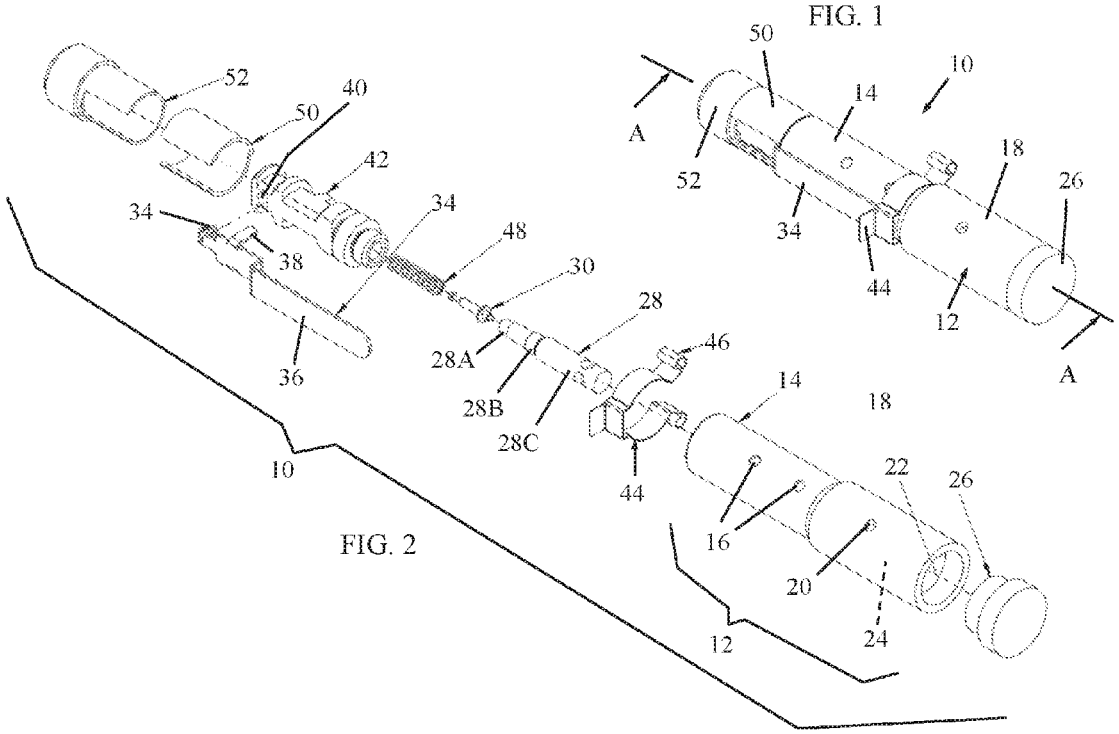
FIG. 1
FIG. 2
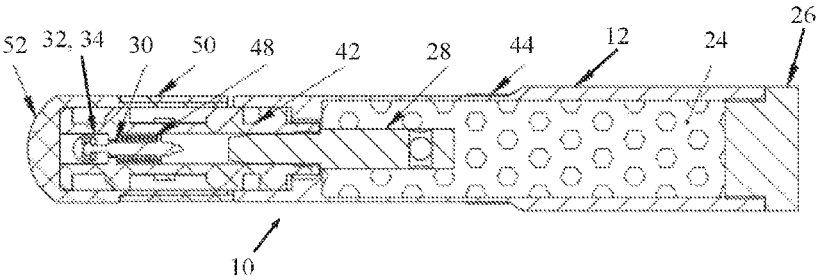
FIG. 3

FIREARM PROJECTILE USABLE AS A HAND GRENADE

FIELD OF THE INVENTION

The present invention relates generally to weapon projectiles, and particularly to a projectile for launching from a weapon, but which is also usable as a hand grenade.

BACKGROUND OF THE INVENTION

Non-lethal hand grenades have been used for many years for riot control and the like. Riot shotguns have been used to launch non-lethal hand grenades. In one version, a cup-type launcher is attached to the muzzle of the shotgun. A regular hand grenade is inserted into the cup launcher, after having first removed the safety pin. The cup holds the safety lever in place until launched. A blank cartridge is fired from the rifle chamber to propel the grenade to the target.

In another version, live ammunition is used to launch the hand grenade. For example, the French Vivien and Bessières shoot-through grenade (VB grenade) has a hole through the middle for a standard bullet to penetrate. Expanding gases from the bullet launch the grenade, and the grenade explodes after a time delay.

The above are examples of converting a hand grenade into a rifle grenade ("rifle grenade" means a grenade launched by a rifle or other weapon).

The patent literature has further examples of combination hand and rifle grenades.

U.S. Pat. No. 1,309,280 (filed December 1918) describes a grenade, which can be used either as a hand grenade or, if desired, as a rifle grenade or mortar bomb. The grenade has two different fuses at opposite ends of the grenade. One fuse is actuated by hand prior to throwing. The other fuse responds to suitable primers, that is, the fuse functions from the explosive force of the cartridge powder from a cartridge fired by the rifle. Both fuses extend inwardly to a common ignitor; the ignitor is arranged to function with either fuse, depending upon the initiating act of the mechanism at either end.

U.S. Pat. No. 1,448,436 (filed October 1919) describes a combination hand and rifle grenade. When used as a hand grenade, the thrower removes a safety pin, which permits a spring-loaded striker to strike a primer to ignite a fuse. When used as a rifle grenade, a bullet (live ammunition) enters a central tube in the grenade. The bullet temporarily blocks the exit of the tube, thereby causing gases formed from the powder charge of the cartridge to accumulate in a chamber in the grenade. The built-up pressure of the accumulated gases propel the grenade outwards. As the bullet passes out of the tube it moves a striker against a primer to ignite the fuse.

SUMMARY OF THE INVENTION

The present invention seeks to provide an improved firearm projectile which can also be used as a hand grenade, as described in more detail further below.

The terms "projectile" or "firearm projectile" are used interchangeably and encompass a cartridge that can be fired from a weapon. The present invention, as opposed to the prior art, provides a novel projectile that is inserted in the chamber or breech of a firearm and launched from the firearm, but which can also be thrown as a hand grenade.

The present invention provides a dual-purpose firearm projectile—it can be inserted in the chamber of the weapon and fired just like any weapon cartridge. However, unlike weapon cartridges, it has another purpose of being throwable as a hand grenade. This is completely different than a hand grenade which is meant to be a hand grenade and can be launched from a cup at the end of a grenade rifle—the rifle merely replaces the force of the hand with the force of the charge. The hand grenade cannot be inserted in the chamber of the rifle. The invention is also different than the abovementioned prior art, in which the fuse is actuated either by hand or rifle; in the prior art, the hand grenade cannot be inserted into the chamber of the rifle.

There is thus provided in accordance with an embodiment of the present invention a method of using a projectile which includes:

a body containing pyrotechnic material, a rear cap that closes a rear end of the body, a pyrotechnic unit including an ignitor in communication with the pyrotechnic material, a striker arranged to strike a primer of the pyrotechnic unit, the striker being biased by a biasing device, a safety lever arranged initially to restrain movement of the striker towards the pyrotechnic unit, and an external safety keeper arranged initially to restrain movement of the safety lever, the projectile having two modes of operation, one as a hand grenade and another as a firearm projectile, wherein for use as a hand grenade, the method includes removing the external safety keeper, gripping the projectile around the safety lever and throwing the projectile, whereupon the safety lever moves to release the striker, which is urged by the biasing device to strike the primer of the pyrotechnic unit to cause ignition of the pyrotechnic material, and wherein for use as a firearm projectile, the method includes inserting the projectile in a chamber of a weapon (e.g., grenade receiving portion of a grenade rifle), which removes thereby the external safety keeper, wherein the projectile is dimensioned so that as long as the projectile is in the chamber, the safety lever engages the striker and prevents the striker from striking the primer of the pyrotechnic unit, and shooting a charge chambered in the weapon, wherein a force of the charge after being shot is directed against the rear cap of the projectile, thereby propelling the projectile out of the weapon, whereupon the safety lever moves to release the striker, which is urged by the biasing device to strike the primer of the pyrotechnic unit to cause ignition of the pyrotechnic material.

There is also provided in accordance with an embodiment of the present invention a projectile including a body containing pyrotechnic material, a rear cap that closes a rear end of the body, a pyrotechnic unit including an ignitor in communication with the pyrotechnic material, a striker arranged to strike a primer of the pyrotechnic unit, the striker being biased by a biasing device, a safety lever arranged initially to restrain movement of the striker towards the pyrotechnic unit, and an external safety keeper arranged initially to clamp a portion of the safety lever to the body.

BRIEF DESCRIPTION OF THE DRAWINGS

The present invention will be understood and appreciated more fully from the following detailed description, taken in conjunction with the drawings in which:

FIGS. 1 and 2 are simplified pictorial and exploded illustrations, respectively, of a projectile which can be used as a hand grenade, constructed and operative in accordance with a non-limiting embodiment of the present invention; and FIG. 3 is a simplified sectional illustration of the projectile, taken along lines A-A in FIG. 1.

DETAILED DESCRIPTION OF EMBODIMENTS

Reference is now made to FIGS. 1-3, which illustrate a projectile 10, constructed and operative in accordance with a non-limiting embodiment of the present invention.

The projectile 10 includes a body 12, which may include a front body portion 14 formed with one or more apertures 16 and a rear body portion 18 formed with one or more apertures 20. Both the front body portion 14 and the rear body portion 18 may be cylindrical in shape, although the invention is not limited to this shape. The front body portion 14 may have a smaller circumference than the rear body portion 18.

Body 12 is shaped as a cartridge which is insertable into the chamber of a weapon, and as such, is preferably cylindrical in shape, but may be of other suitable shapes depending on the weapon. As is known in the art, the chamber is the part of the weapon into which a cartridge is inserted; the chamber is in the breech of the weapon.

The body 12 has an inner chamber 22 which may contain pyrotechnic material 24. For example, material 24 may include a non-lethal pyrotechnic material for riot control, such as but not limited to, chemical irritant agents, e.g., CS (o-chlorobenzylidene malononitrile) or OC (oleoresin capsicum). As another example, material 24 may include material used in flash-bang devices, such as but not limited to, magnesium or ammonium nitrate pyrotechnic mixtures used in stun grenades (less-lethal grenades), or a combination of pyrotechnic charge and balls or pellets, such as in non-lethal bursting hand grenades that release a shower of pellets to sting and disorient individuals.

The above are intended for use as non-lethal or less-lethal materials. In another embodiment of the invention, the projectile may be used with lethal materials.

A rear cap 26 is provided to close the rear end of the body 12.

For use with pyrotechnic materials, projectile 10 includes a pyrotechnic unit 28, which includes a primer 28A, delay fuse 28B and ignitor 28C. As seen in FIG. 3, the ignitor 28C communicates with pyrotechnic material 24 for ignition thereof. After ignition, the pyrotechnic material 24 exits through apertures 16 and 20.

A striker 30 is arranged to strike primer 28A of the pyrotechnic unit 28. As seen in FIG. 3, striker 30 is initially restrained by a lug 32 of a safety lever 34. Safety lever 34 may include a resilient lever 36 and tabs 38. Lug 32 enters through a port 40 formed in a safety housing 42 in which striker 30 is disposed. Tabs 38 resiliently attach to the outer contour of safety housing 42.

Safety lever 34 is initially held in place on safety housing 42 by an external safety keeper 44, which may include arcuate protrusions 46. Striker 30 is biased by a biasing device 48, such as a coil spring. In the initial position shown in FIG. 3, biasing device 48 is compressed. When external safety keeper 44 is removed, the resilient lever 36 of safety lever 34 moves (radially outwards), which releases lug 32 from striker 30. The force of biasing device 48 causes striker 30 to strike primer 28A of the pyrotechnic unit 28, which eventually causes ignition of pyrotechnic material 24.

The forward part of projectile 10 may include an auxiliary safety 50, which may be turned to keep safety lever 34 against the safety housing 42 (as an added safety measure to external safety keeper 44). A front cap 52 closes the forward part of projectile 10.

When used as a hand grenade, the thrower simply removes the external safety keeper 44 (and, if necessary, turns the auxiliary safety 50), grips the projectile around the resilient lever 36 of safety lever 34 and throws the projectile. The resilient lever 36 of safety lever 34 is now free to move radially outwards, which releases lug 32 from striker 30, which is urged by biasing device 48 to strike primer 28A of the pyrotechnic unit 28, which eventually causes ignition of pyrotechnic material 24.

When used as a rifle projectile, the user simply inserts projectile 10 in the chamber of a weapon, such as the grenade receiving portion of a standard grenade rifle (not shown). The action of inserting the projectile in the chamber removes the external safety keeper 44. If auxiliary safety 50 is used, the shooter may turn the auxiliary safety 50 when placing the projectile in the weapon so that auxiliary safety 50 does not interfere with movement of safety lever 34. The projectile is dimensioned so that as long as the projectile is in the chamber, the safety lever 34 remains close to the safety housing 42 and lug 32 still engages striker 30. A blank cartridge (or other suitable charge) is then chambered in the weapon (e.g., behind the projectile in the chamber of the grenade rifle). The force of the shot charge is directed against rear cap 26 of the projectile, thereby propelling the projectile out of the barrel of the grenade rifle. The resilient lever 36 of safety lever 34 is now free to move radially outwards, which releases lug 32 from striker 30, which is urged by biasing device 48 to strike primer 28A of the pyrotechnic unit 28, which eventually causes ignition of pyrotechnic material 24. The rear cap 26 is made of a material that can withstand the brunt of the explosive charge from the weapon.

What is claimed is:

1. A method of using a projectile comprising:

providing a projectile having a body shaped as a cartridge insertable into a chamber of a breech of a weapon, wherein the projectile is fireable from the chamber of the weapon but also throwable as a hand grenade, wherein said projectile comprises:

a body containing pyrotechnic material;

a rear cap that closes a rear end of said body;

a pyrotechnic unit comprising an ignitor in communication with said pyrotechnic material;

a striker arranged to strike a primer of said pyrotechnic unit, said striker being biased by a biasing device;

a safety lever arranged initially to restrain movement of said striker towards said pyrotechnic unit; and an external safety keeper arranged initially to restrain movement of said safety lever;

said projectile having two modes of operation, one as a hand grenade and another as a firearm projectile, wherein for use as a hand grenade, the method comprises removing said external safety keeper, gripping the projectile around said safety lever and throwing the projectile, whereupon said safety lever moves to release said striker, which is urged by said biasing device to strike said primer of the pyrotechnic unit to cause ignition of said pyrotechnic material; and wherein for use as a projectile, the method comprises inserting said projectile in said chamber of the breech, wherein the action of inserting the projectile in the chamber removes the external safety keeper, wherein said projectile is dimensioned so that as long as said projectile is in the chamber, said safety lever engages said striker and prevents said striker from striking said primer of the pyrotechnic unit, and shooting a charge chambered in the weapon, wherein a force of the charge after being shot is directed against said rear cap of the projectile, thereby propelling the projectile out of the weapon, whereupon said safety lever moves to release said striker, which is urged by said biasing device to strike said primer of the pyrotechnic unit to cause ignition of said pyrotechnic material.

2. The method according to claim 1, wherein said pyrotechnic material comprises a non-lethal pyrotechnic material for riot control.

3. The method according to claim 1, wherein said pyrotechnic material comprises a chemical irritant agent.

* * * * *